United States Patent [19]

Obrist

[11] Patent Number: 4,671,431

[45] Date of Patent: Jun. 9, 1987

[54] DISPENSING CONTAINER FOR HIGHLY VISCOUS PACKAGE COMPONENT AND EXPLUSION DEVICE FOR THE CONTAINER

[75] Inventor: Gerhard Obrist, Kaiseraugst, Switzerland

[73] Assignee: Aerosol-Service Ag, Möhlin, Switzerland

[21] Appl. No.: 726,005

[22] Filed: Apr. 22, 1985

[30] Foreign Application Priority Data

May 3, 1984 [CH] Switzerland ..... 2142/84
Aug. 23, 1984 [CH] Switzerland ..... 4022/84

[51] Int. Cl.[4] ..... B67D 5/46

[52] U.S. Cl. ..... 222/327; 222/389; 222/402.13; 222/402.15; 222/490

[58] Field of Search ..... 222/327, 389, 397, 399, 222/396, 326, 490, 402.1, 402.13, 402.15, 402.23, 402.22

[56] References Cited

U.S. PATENT DOCUMENTS 3,217,932 11/1965 Steiner .
3,250,443 5/1966 Abbott, Jr. .
3,367,545 2/1968 Cook .
3,519,170 7/1970 Lankelma ..... 222/399
3,568,892 3/1971 burk ..... 222/327
3,648,905 3/1972 Kauder ..... 222/402.23
4,174,068 11/1979 Rudolph ..... 222/327
4,277,004 7/1981 Barlics ..... 222/402.13
4,386,717 6/1983 Koob ..... 222/389

FOREIGN PATENT DOCUMENTS 0923091 3/1973 Canada ..... 222/389

*Primary Examiner*—Robert J. Spar
*Assistant Examiner*—P. McCoy Smith
*Attorney, Agent, or Firm*—Werner W. Kleeman

[57] ABSTRACT

A conventional pressurized gas container in the form of a standard aerosol container is fastened to a commercially available standard cartridge having a movable piston by means of an adapter. The adapter of the dispensing container contains an actuating member for the valve of the pressurized gas container and a pressure exhaust or venting orifice which is in flow communication with a pressure chamber situated between the piston and the adaptor and such pressure venting orifice is obturatable by the finger of an operator in service. The dispensing container is particularly simple in design and fulfills all practical requirements in service and manipulation.

10 Claims, 4 Drawing Figures

DISPENSING CONTAINER FOR HIGHLY VISCOUS PACKAGE COMPONENT AND EXPLUSION DEVICE FOR THE CONTAINER

BACKGROUND OF THE INVENTION

The present invention broadly relates to dispensing containers and, more specifically, pertains to a new and improved construction of a dispensing container for a highly viscous filler material or package component and to a new and improved construction of an expulsion device for such dispensing container.

Generally speaking, the dispensing container of the present invention comprises: a cartridge containing the highly viscous filler material, the cartridge having a forward end and a rear end and defining a longitudinal direction; the forward end being provided with a dispensing orifice for the highly viscous filler material or package component; the cartridge comprising a longitudinally translatable piston for expelling the highly viscous filler material or package component; an adapter for a conventional pressurized gas container sealingly fastenable to the rear end of the cartridge, the adapter sealingly closing the rear end of the cartridge and defining conjointly with the piston a pressure chamber devoid of the highly viscous filler material or package component; the dispensing container defining a forward direction and the adapter being structured to connect a conventional pressurized gas container with the pressure chamber for generating a pressure cushion or pressure charge active upon the piston for driving the piston in the forward direction.

The expulsion device of the present invention is intended for a dispensing container for a highly viscous filler material or package component. This dispensing container is in the form of a cartridge having a rear end and a piston moveably arranged therein and comprises: an adapter for a conventional pressurized gas container and sealingly fastened to the rear end of the cartridge; the adapter accommodating the conventional pressurized gas container, sealingly closing the rear end of the cartridge and defining conjointly with the piston a pressure chamber devoid of the highly viscous filler material or package component; the expulsion device defining a forward direction and the adapter being structured to connect the conventional pressurized gas container with the pressure chamber for generating a pressure cushion or pressure charge active upon the piston for driving the piston in the forward direction.

Numerous highly viscous or pasty products such as caulking compounds, putties, adhesives and the like are now packaged in cartridges. Standard cartridges are cylindrical containers provided with a usually conically convergent application orifice at their forward end and closed at their other end by a movable piston. For removing the product from the cartridge, the cartridge is inserted into an application device by means of which the piston is either manually or pneumatically pressed forward, thus expelling the product.

The manually operated application devices work in discrete portions and therefore do not permit a uniformly continuous bead or strand of product. Furthermore, the requisite piston rod can be disturbing and the manual pumping can often lead to rapid fatigue.

The pneumatic application devices do not exhibit these disadvantages but are relatively complicated in design and are dependent upon a compressor or the like, so that they remain practically exclusively reserved for professional usage.

A cartridge package is also known, for instance, from the U.S. Pat. No. 3,568,892, granted Mar. 9, 1971, in which the cartridge containing the filler material is clamped in a holder analogous to the situation in the above-mentioned manually operated packages. In contradistinction to the latter, an aerosol pressure container is provided in this package which generates a pressurized gas cushion between the cartridge piston and a support plate of the holder sealingly closing the end of the cartridge. This pressure cushion bears upon the piston and thereby drives out the filler material. The supply of pressure medium from the pressure container into the pressure chamber between the cartridge piston and the support plate is controlled by a trigger mechanism acting upon the pressurized container or its valve.

This known cartridge package is relatively complicated in design for a mass-produced product and furthermore does not permit stopping the dispensing of filler material as long as the pressure cushion is still strong enough to drive the piston forwards in the cartridge.

A further pressurized gas-actuated cartridge package is known, for instance from the U.S. Pat. No. 3,217,932, granted Nov. 16, 1965. In this package, the cartridge is not situated in a holder of its own, but the aerosol pressure container is fastened to the rear end of the cartridge by means of a special adapter. A threaded nipple is provided in the adapter upon which an appropriately formed valve component of the pressure container can be screwed, thereby sealingly connecting the pressurized container to the cartridge and fixing it thereupon, while a pressurized gas cushion simultaneously is formed in the rear end of the cartridge which acts upon the cartridge piston and drives the latter forward as long as a special application valve screwed onto the forward end of the cartridge is open.

In this known cartridge package the control of the dispensing of the product is therefore effected via the application valve and the cartridge is constantly under service pressure. The latter is disadvantageous for various reasons. Furthermore, this known cartridge package is still relatively complicated in design.

Other constructions of dispensing devices are exemplified by U.S. Pat. No. 3,250,443, granted May 10, 1966 and U.S. Pat. No. 3,367,545, granted Feb. 6, 1968.

SUMMARY OF THE INVENTION

Therefore, with the foregoing in mind, it is a primary object of the present invention to provide a new and improved construction of a dispensing container for a highly viscous filler material or package component which does not exhibit the aforementioned drawbacks and shortcomings of the prior art constructions.

Another and more specific object of the present invention aims at providing a new and improved construction of a dispensing container of the previously mentioned type as well as an expulsion device for such a dispensing container which both exhibit an extremely simple and correspondingly economical design, on the one hand, and with which, on the other hand, a manner of operation and function convenient in practice can be attained while avoiding the above-described faults or limitations of the known cartridge packages of this type.

Yet a further significant object of the present invention aims at providing a new and improved construction of a dispensing container and of an expulsion device of the character described which are relatively simple in construction and design, extremely economical to manufacture, highly reliable in operation, not readily subject to breakdown and malfunction and require a minimum of maintenance and servicing.

Now in order to implement these and still further objects of the invention, which will become more readily apparent as the description proceeds, the dispensing container of the present invention is manifested by the features that: the conventional pressurized gas container is of the type equipped with a recloseable valve; the adapter comprises means for actuating the recloseable valve of the conventional pressurized gas container; a pressure exhaust or venting orifice is provided in the adapter and communicates with the pressure chamber and with ambient air; and the pressure exhaust or venting orifice is arranged such that the pressure exhaust or venting orifice is simply obturatable by a finger of an operator when the dispensing container is in service.

The expulsion device of the present invention is manifested by the features that: the conventional pressurized gas container is of the type equipped with a recloseable valve; the adapter comprises means for actuating the recloseable valve of the conventional pressurized gas container; a pressure exhaust or venting orifice is provided in the adapter and communicates with the pressure chamber and with ambient air; and the pressure exhaust or venting orifice is arranged such that the pressure exhaust or venting orifice is simply obturatable by a finger of an operator when the expulsion device is in service.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
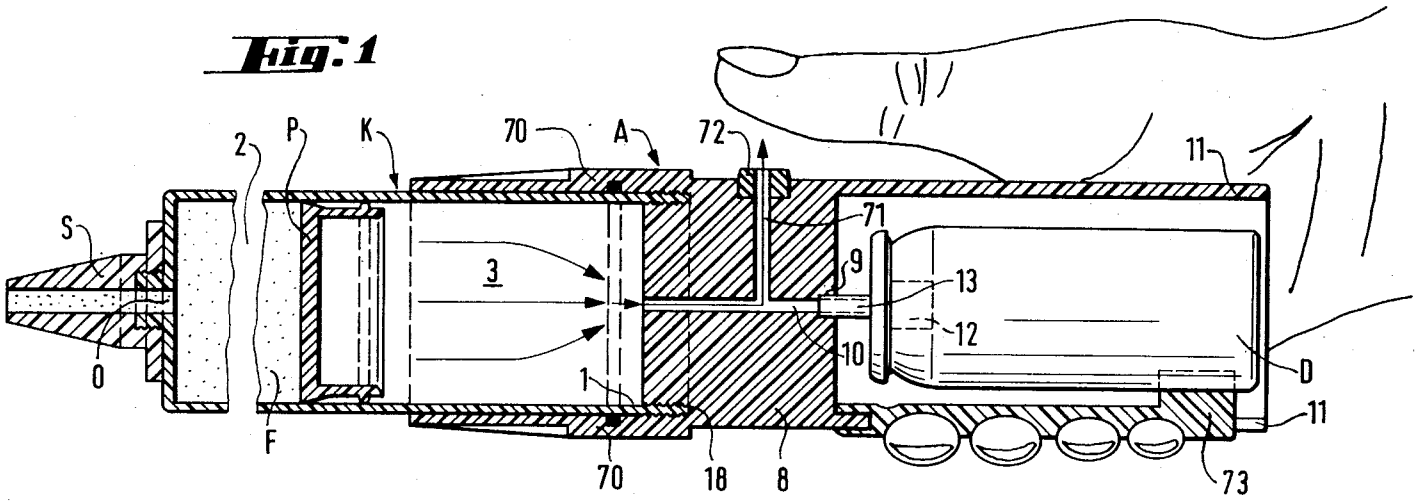
FIG. 1 schematically illustrates a longitudinal section through a first embodiment of the invention in a first phase of operation.

Describing now the drawings, it is to be understood that to simplify the showing thereof only enough of the structure of the dispensing container and of the expulsion device has been illustrated therein as is needed for one skilled in the art to readily understand the underlying principles and concepts of this invention. Turning now to FIG. 1 of the drawings, the apparatus illustrated therein by way of example and not limitation will be seen to comprise a plastic cartridge K having a dispensing orifice O and a screwed-on application tip S, a piston P moveably arranged and sealingly seated within the cartridge K and an adapter A for a standard aerosol pressure container D. The adapter A is sealingly fastened at the rear end 1 of the cartridge K to this cartridge K which would otherwise remain open. A highly viscous or pasty filler material or package component F to be dispensed is situated in a forward space 2 of the cartridge K between the piston P and the dispensing orifice O. The rear cartridge space situated between the piston P and the attached or inserted adapter A is devoid of filler material and is designated in the following as the pressure chamber 3.

The adapter A has the shape of an H in longitudinal section and comprises a bulkhead or body member 8 and two sleeves 11 and 70 extending therefrom. The sleeve 70 at the left in FIG. 1 surrounds the rear end 1 of the cartridge K. Additionally, an annular groove 18 is provided in the body member 8 for accommodating the outer edge of the cartridge end 1. In this manner the adapter A is firmly and sealingly fastened to the rear end 1 of the cartridge K.

Figure 2:
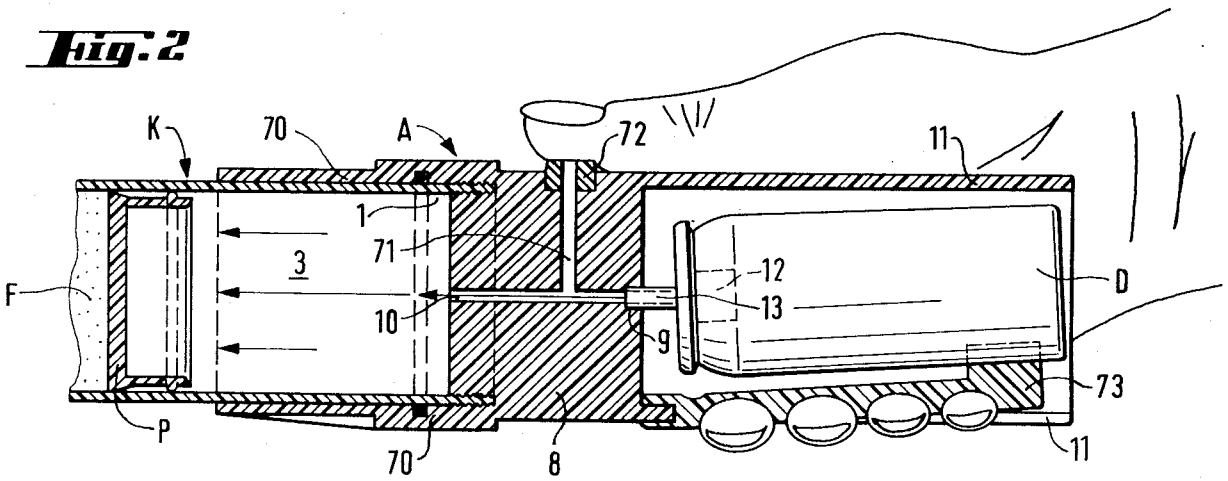
FIG. 2 schematically illustrates a longitudinal section through the first embodiment of the invention in a second phase of operation.

A through conduit or open-ended passage 10 is provided in the body member 8 coaxial to the adapter A. The opening or bore 9 of this open-ended passage 10 remote from the cartridge K is enlarged for accommodating a dispensing tubelet 13 of a dispensing valve 12 of the pressurized gas container D. The latter is situated in the sleeve 11 of the adapter A and is retained in the adapter A only by its dispensing tubelet 13. Its dispensing valve 12 is here constructed as a standard tipping or canting valve, i.e. it can be opened by laterally tipping or canting the dispensing tubelet 13 in relation to the pressurized gas container D. An elastically inwardly pressable hand grip 73 is provided in the retainer sleeve 11 by means of which the pressurized gas container D can be laterally pivoted or rocked in the manner shown in FIG. 2 and its valve 12 thereby opened.

A pressure exhaust or venting conduit or passage 71 branches laterally from the open-ended passage 10 penetrating the body member 8. The pressure exhaust or venting conduit or passage 71 opens into ambient air laterally of the adapter A through a nipple or pressure exhaust or venting orifice 72.

In order to prepare the dispensing container for service, the pressurized gas container D is inserted into the adapter A in accordance with FIG. 1. Then the pressure exhaust or venting passage 71 is obturated with the thumb or another digit and the pressurized gas container D is laterally deflected by means of the hand grip 73 in accordance with FIG. 2. The canting or rocked dispensing valve 12 of the pressurized gas container D is thereby opened and the requisite pressure for driving out or expelling the highly viscous filler material or package component F builds up in the pressure chamber 3 in the cartridge end 1. As soon as this pressure is attained, the hand grip 73 can be released so that the pressurized gas container D returns to its original position visible in FIG. 1 and in which its canting dispensing valve 12 is closed. If the removal of filler material is to be interrupted, the pressure exhaust or venting passage 71, respectively its venting orifice 72, need only be released, i.e. opened to the ambient air. The gauge pressure in the pressure chamber 3 then immediately collapses, as will be evident from FIG. 1.

Figure 3:
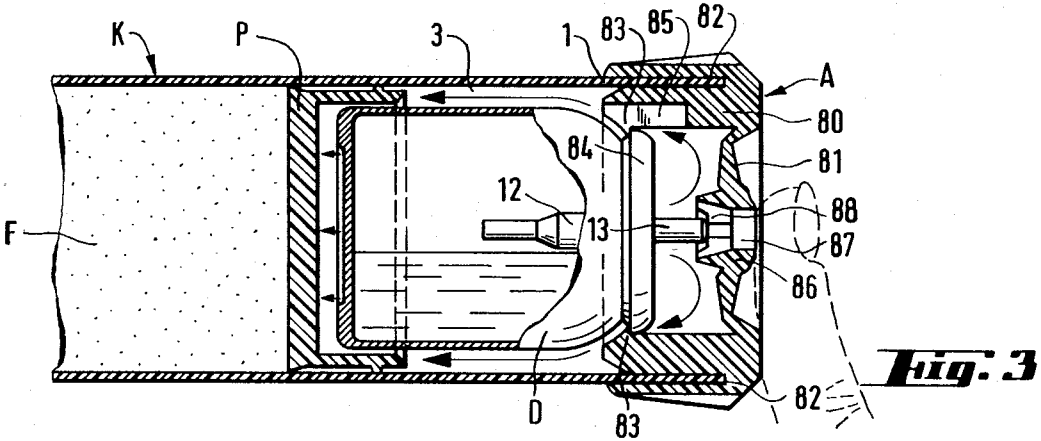
FIG. 3 schematically illustrates an analogous representation of a second embodiment in a first phase of operation.
Figure 4:
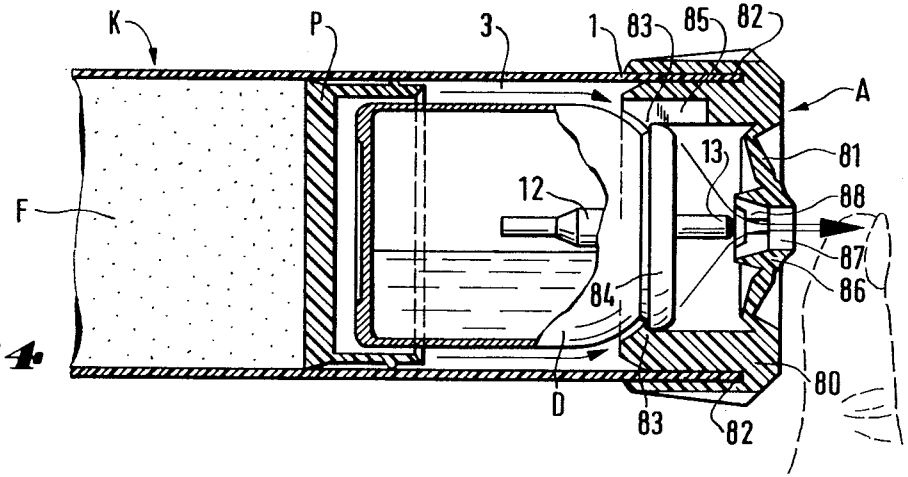
FIG. 4 schematically illustrates an analogous representation of the second embodiment of the invention in a second phase of operation.

A particularly compact and extremely simple design and practical embodiment of the invention is shown in FIGS. 3 and 4.

In this embodiment of the invention, the adapter A comprises a relatively stable ring or annular body or annulus 80 and a diaphragm or floor component 81 formed elastically in the annulus 80. The annulus 80 comprises an annular gap 82 and is pressed over the rear end 1 of the cartridge K with a press fit, the cartridge rear end 1 seating in the annular gap 82.

The annulus 80 comprises retention members or tabs 83 protruding somewhat elastically inward or possibly an analogous retention ring or annular ledge in its interior. These retention tabs 83 engage a valve cover 84 of the pressurized gas container D and fasten the pressurized gas container D in the adapter A in this manner. The pressurized gas container D is, in contradistinction to all other embodiments, here inverted with its dispensing valve 12 facing in the direction of the rear end 1 of the cartridge K. Communicating channels 85 are also provided in the annulus 80 which establish a connection between the spaces situated before and behind the valve cover 84 retained by the retention tabs 83.

The diaphragm or floor component 81 is relatively stable in its central region but is relatively elastic and folded at its edge region, so that it is axially elastically inwardly movable. The center of the diaphragm 81 is constructed as a hollow nipple 86 which is provided with a through-pressure or open-ended exhaust or venting orifice 87 and support or bearing ribs 88 for the dispensing tubelet 13 of the dispensing valve 12 of the pressurized gas container D.

The diaphragm 81 is normally situated in the idle position shown in FIG. 4 and in which the support or bearing ribs 88 are lifted from the dispensing tubelet 13 of the dispensing valve 12 or at least exert no axial pressure upon the latter.

To establish the gauge pressure requisite for removing filler material, the pressure exhaust or venting orifice 87 is obturated by a finger and simultaneously the hollow nipple 86 is pressed axially inward according to FIG. 3. The support or bearing ribs 88 come into contact with the dispensing tubelet 13 and also press the latter axially inward until the dispensing valve 12 finally opens. Now the pressurized gas flows between the support or bearing ribs 88 and through the communication channels 85 into the pressure chamber 3 of the cartridge K situated behind the valve cover 84. When the desired operational pressure, which may be about 2.5 bar, is attained, the pressing force upon the hollow nipple 86 is removed but the pressure exhaust or venting orifice 87 is kept obturated. The removal of filler material then continues to proceed. For interrupting the removal of filler material, the finger is simply lifted from the hollow nipple 86, thus freeing the pressure exhaust or venting orifice 87 and depressurizing the pressure chamber 3, according to FIG. 4.

In both of the embodiments illustrated, the adapter A is fastened to the cartridge K by a press fit. Naturally other types of fastening are possible. For instance, the adapter A could also be welded to the cartridge K or connected thereto by a suitable flanging or flaring.

The adapter A forms conjointly with the pressurized gas container D an expulsion device for the filler material or package component F situated in the cartridge K. This expulsion device either can be fastened to the cartridge K during fabrication or can form an independent unit which can then be employed as an exchangeable expulsion device for many cartridges if provided with a suitable type of fastening.

The dispensing container of the invention and the expulsion device of the invention for a piston-type cartridge both unite all advantages of hitherto known devices of this type without simultaneously exhibiting their disadvantages. In particular, a uniform continuous application of the filler material or package component F is assured by this dispensing container and by this expulsion device with a minimum of structural complication. Manipulation is simple and fatigue-free and the dispensing container is always automatically pressure-relieved when not in operation.

While there are shown and described present preferred embodiments of the invention, it is to be distinctly understood that the invention is not limited thereto, but may be otherwise variously embodied and practiced within the scope of the following claims. Accordingly,

What I claim is:

1. A dispensing container for a highly viscous filler material, comprising:

a cartridge containing the highly viscous filler material;

said cartridge having a forward end and a rear end and defining a forward longitudinal direction;

said forward end being provided with a dispensing orifice for the highly viscous filler material;

said cartridge comprising a longitudinally translatable piston for expelling the highly viscous filler material;

an adapter for a pressurized gas container having a recloseable valve and sealingly fastened to said rear end of said cartridge;

said adapter sealingly closing said rear end of said cartridge and defining conjointly with said piston a pressure chamber devoid of the highly viscous filler material;

said adapter being structured to connect said pressurized gas container with said pressure chamber for generating a pressure charge active upon said piston for driving said piston in said forward longitudinal direction;

said adapter comprising means for actuating said recloseable valve of said pressurized gas container;

a pressure venting orifice provided in said adapter and communicating with said pressure chamber and with ambient air;

said pressure venting orifice being arranged such that said pressure venting orifice is obturatable by a digit of an operator when the dispensing container is in service;

said adapter consisting primarily of an annular body and a diaphragm;

said annular body being structured to be sealingly connected with said rear end of said cartridge;

said annular body having an interior and being provided with retention members in said interior;

said pressurized gas container having a cover member;

said retention members being structured to engage said cover member for fastening said cover member to said adapter such that said cover is substantially immobilized in relation to said annular body;

said recloseable valve of said pressurized gas container being an aerosol valve having a dispensing tubelet whcih can be elastically pressed inward for opening;

said diaphragm being connected with said annular body such that said diaphragm is elastically limitedly axially inwardly movable;

said diaphragm having an innermost position;

said diaphragm being structured to open said recloseable valve of said pressurized gas container when in said innermost position;

said diaphragm having a central region; and said pressure venting orifice being provided in said central region.

2. The dispensing container as defined in claim 1, wherein:

said central region defines a hollow nipple; and said central region has an inner side and is provided with bearing ribs for the dispensing tubelet of the pressurized gas container on said inner side.

3. The dispensing container as defined in claim 1, wherein;

said annular body is provided with an annular groove for accommodating said rear end of said cartridge.

4. A dispensing container for a highly viscous filler material, comprising:

a cartridge for containing the highly viscous filler material;

said cartridge having a forward end and a rear end and defining a longitudinal direction;

said forward end being provided with a dispensing orifice for the highly viscous filler material;

said cartridge containing a longitudinally translatable piston for expelling the highly viscous filler material;

an adapter for a pressurized gas container having a recloseable valve and sealingly fastened to said rear end of said cartridge;

said adapter sealingly closing said rear end of said cartridge and defining conjointly with said piston a pressure chamber devoid of the highly viscous filler material;

said cartridge defining a forward direction of said longitudinal translatable piston for expelling the highly viscous filler material;

said adapter being structured to connect said pressurized gas container with said pressure chamber for generating a pressure charge active upon said longitudinal translatable piston for driving said longitudinally translatable piston in said forward direction;

said adapter comprising means for actuating said recloseable valve of said pressurized gas container;

a pressure venting orifice provided in said adapter and communicating with said pressure chamber and with ambient air;

said pressure venting orifice being arranged such that said pressure venting orifice is obturatable by a digit of an operator when the dispensing container is in service;

said pressure venting orifice opening laterally of said adapter;

said adapter comprising a substantially annular sleeve for surrounding said rear end of said cartridge and for sealingly fastening said adapter to said rear end of said cartridge;

said adapter comprising a body portion closing said rear end of said cartridge and separating said pressurized gas container from said pressure chamber;

said adapter comprising a sleeve-shaped retention means for pivotably accommodating said pressurized gas container and which is connected with said body portion;

said recloseable valve of said pressurized gas container being an aerosol valve having a tubelet serving simultaneously for actuation of said recloseable valve and for dispensing the contents of said pressurized gas container;

said body portion being provided with a bore for accommodating and substantially immobilizing the dispensing tubelet of said releasable valve of said pressurized gas container;

said cartridge having an interior;

said body portion being provided with a passage for connecting said bore with said interior of said cartridge;

said adapter having a lateral outer surface;

said body portion separating said pressurized gas container from said pressure chamber containing said pressure venting orifice which flow communicates with said passage and opens on said lateral outer surface;

said bore and said passage being arranged in said body portion separating said pressurized gas container from said pressure chamber such as to permit flow from said pressure chamber and said pressurized gas container in opposite directions towards said pressure ventinq orifice when the latter is no longer obturated by the digit of the operator;

said recloseable valve of said pressurized gas container being a canting valve;

said actuating means for said recloseable valve comprising a moveable hand grip provided on said sleeve-shaped retention means; and said pressurized gas container pivotably accommodated in said sleeve-shaped retention means being capable of being pivoted relative to the substantially immobilized dispensing tubelet by said hand grip for opening said canting valve.

5. The dispensing container as defined in claim 4, wherein:

said adapter is provided with an annular groove for accommodating said rear end of said cartridge.

6. An expulsion device for a dispensing container in the form of a cartridge having a rear end and a piston moveably arranged therein for dispensing a highly viscous filler material, comprising:

a pressurized gas container;

a recloseable valve provided in said pressurized gas container;

an adapter for said pressurized gas container sealingly fastened to the rear end of the cartridge;

said adapter serving for pivotably accommodating said pressurized gas container, for sealingly closing the rear end of the cartridge and for defining conjointly with the piston a pressure chamber devoid of the highly viscous filler material;

the cartridge defining a forward direction for expelling the highly viscous filler material;

said adapter being structured to connect said pressurized gas container with said pressure chamber for generating a pressure charge active upon the piston for driving the piston in said forward direction;

said adapter comprising means for actuating said recloseable valve of said pressurized gas container;

a pressure venting orifice provided in said adapter and communicating with said pressure chamber;

said pressure venting orifice being arranged such that said pressure venting orifice is obturatable by a finger of an operator when the expulsion device is in service;

said pressure venting orifice opening laterally of said adapter;

said adapter comprising a body portion capable of closing said rear end of the cartridge and separating said pressurized gas container from said pressure chamber;

said adapter comprising a sleeve-shaped retention means for said pressurized gas container and which is connected with said body portion;

said body portion being provided with a bore for accommodating and substantially immobilizing a dispensing tubelet of said recloseable valve of said pressurized gas container;

said body portion being provided with a passage capable of connecting said bore with the interior of the cartridge;

said adapter having a lateral outer surface;

said body portion separating said pressurized gas container from said pressure chamber containing said pressure venting orifice which flow communicates with said passage and opens on said lateral outer surface;

said bore and said passage being arranged in said body portion separating said pressurized gas container from said pressure chamber such as to permit flow from said pressure chamber and said pressurized gas container in opposite directions towards said pressure venting orifice when the latter is no longer obturated by the digit of the operator;

said recloseable valve of said pressurized gas container being a canting valve;

said actuating means for said recloseable valve comprising a moveable hand grip provided on said sleeve-shaped retention means; and said pressurized gas container pivotably accomodated in said adapter being capable of being pivoted relative to said substantially immobilized tubelet by said hand grip for opening said canting valve.

7. Expulsion device as defined in claim 6, wherein:

said adapter is provided with an annular groove for accomodating said rear end of the cartridge.

8. An expulsion device for a dispensing container being in the form of a cartridge having a rear end and a piston arranged therein for expelling a highly viscous filler material, comprising:

a pressurized gas container;

a recloseable valve provided in said pressurized gas container;

an adapter for said pressurized gas container sealingly fastened to the rear end of the cartridge;

said adapter serving for accommodating said pressurized gas container, for sealingly closing the rear end of the cartridge and for defining conjointly with the piston a pressure chamber devoid of the highly viscous filler material;

the cartridge defining a forward direction for expelling the highly viscous filler material;

said adapter being structured to connect said pressurized gas container with said pressure chamber for generating a pressure charge active upon the piston for driving the piston in said forward direction;

said adapter comprising means for actuating said recloseable valve of said pressurized gas container;

a pressure venting orifice provided in said adapter and communicating with said pressure chamber;

said pressure venting orifice being arranged such that said pressure venting orifice is obturatable by a finger of an operator when the expulsion device is in service;

said adapter consisting substantially of an annular body and a diaphragm;

said annular body being structured to be sealingly connected with said rear end of said cartridge;

said annular body having an interior and being provided with retention members in said interior;

said pressurized gas container having a cover member;

said retention members being structured to engage said cover member for fastening said cover member to said adapter such that said cover member is substantially immobilized in relation to said annular body;

said recloseable valve of said pressurized gas container being an aerosol valve having a dispensing tubelet which can be elastically pressed inward for opening;

said diaphragm being connected with said annular body such that said diaphragm is elastically limitedly axially inwardly movable;

said diaphragm having an innermost position;

said diaphragm being structured to open said recloseable valve of said pressurized gas container when in said innermost position;

said diaphragm having a central region; and said pressure venting orifice being provided in said central region.

9. The expulsion device as defined in claim 8, wherein:

said central region defines a hollow nipple; and said central region has an inner side and is provided with bearing ribs for the dispensing tubelet of said pressurized gas container on said inner side.

10. The expulsion device as defined in claim 8, wherein:

said annular body is provided with an annular groove for accommodating said rear end of the cartridge.

* * * * *